United States Patent [19]

Seki et al.

[11] Patent Number: 4,565,479

[45] Date of Patent: Jan. 21, 1986

[54] RAW MATERIALS CHARGING DEVICE FOR PREHEATING FURNACE

[75] Inventors: Masahiko Seki; Hiroshi Nakatani; Shozo Minami; Katsuya Kogumasaka, all of Kitakyushu, Japan

[73] Assignee: Nippon Steel Corp., Kitakyushu, Japan

[21] Appl. No.: 586,463

[22] Filed: Mar. 5, 1984

[30] Foreign Application Priority Data

Mar. 10, 1983 [JP] Japan ..... 58-34426[U]

[51] Int. Cl.[4] ..... B66C 3/00

[52] U.S. Cl. ..... 414/199; 294/68.21; 294/68.23

[58] Field of Search ..... 414/160, 172, 180, 185, 414/191, 199; 294/69 R, 69 A, 70–72

[56] References Cited

U.S. PATENT DOCUMENTS

| | | | |
|---|---|---|---|
| 2,784,025 | 3/1957 | Beckenbach | 414/191 X |
| 3,418,019 | 12/1968 | Fadler | 414/199 X |
| 3,524,005 | 8/1970 | Scott | 414/185 X |

*Primary Examiner*—Robert G. Sheridan

*Attorney, Agent, or Firm*—Pollock, Vande Sande & Priddy

[57] ABSTRACT

A raw materials charging device for a preheating furnace including a bucket having a main body, an outer cylinder and an inner cylinder inserted coaxially with the main body in the outer cylinder for vertical movement independently of each other, and a bottom plate split into a plurality of bottom plate sections for movement outwardly from a central portion of the bottom plate to open and close the same.

8 Claims, 6 Drawing Figures

RAW MATERIALS CHARGING DEVICE FOR PREHEATING FURNACE

BACKGROUND OF THE INVENTION

This invention relates to a raw materials charging device suitable for use in the field of steel making performed by using an electric furnace for preheating raw materials, such as scrap, by preheating.

Heretofore, in one process known in the art for preheating raw materials for steel making in a preheating furnace, the raw materials or scrap is introduced into the preheating furnace through its throat and released therefrom through its bottom. In another process known in the art, the direction of flow of the exhaust gas is reversed and it is introduced into the preheating furnace through its bottom and released through its throat. These processes of the prior art have suffered the disadvantage that only those raw materials which are disposed in the vicinity of a furnace wall are preheated and those raw materials which are disposed in a central portion of the furnace are difficult to preheat due to the exhaust gas blowing through between the furnace wall and the raw materials, with a result that difficulties are experienced in effecting uniform preheating of the raw materials in the furnace and full realization of the advantages from performing preheating is hampered.

To obviate this disadvantage, proposals have been made to form a passage through a stack of raw materials in the preheating furnace for gas of high temperature to flow therethrough to enable heat exchange to take place between the gas of high temperature and scrap of low temperature. This process is intended to reduce a pressure loss of the gas of high temperature blown through the furnace while enabling uniform preheating of the scrap to be performed. One example of a device suitable for carrying this process into practice is disclosed in Japanese Utility Model Publication No. 37039/82, which is constructed such that gas of high temperature is introduced through an upper portion of a bucket and released through a lower portion thereof. A main body of a jig is set in position in an empty bucket and raw materials for steel making, such as scrap, are charged into the bucket. Then, a suspended frame is moved upwardly to withdraw the main body of the jig from the bucket and form a plurality of gas passages in a stack of scrap. The bucket is conveyed to where a preheating pit is located to introduce waste gas into the bucket, which is then sealed by placing a hood thereon. The waste gas thus introduced into the bucket vigorously flows through the gas passages into layers of the scrap, and a pressure loss of the waste gas is reduced to one-half of its value in the prior art. Thus, the rate of heat exchange taking place between the waste gas flowing through the bucket and the raw materials for steel making charged into the bucket is doubled, thereby improving a heat recovery rate and increasing the speed at which the raw materials for steel making in the bucket are preheated. In this construction, the gas essentially flows only through the gas passages formed beforehand in the stack of raw materials before being released from the furnace, so that the device is considerably low in preheating efficiency. Also, since the exhaust gas is released through the bottom of the furnace, it is necessary to provide a bucket opening and closing mechanism with means for insulating heat when the exhaust gas used is high in temperature. This would cause a rise in production cost, and the device would have the additional disadvantage of being short in service life due to wear and deformation that might be caused thereon.

SUMMARY OF THE INVENTION

This invention has been developed for the purpose of obviating the aforesaid disadvantages of the prior art. Accordingly, the invention has as its object the provision of a raw materials charging device of a bucket type suitable for use with a preheating furnace allowing a gas passage to be readily formed in a stack of raw materials in the preheating furnace while facilitating charging the preheating furnace with raw materials.

According to the invention, there is provided a raw materials charging device comprising a main body of a bucket for charging raw materials, wherein the improvement comprises a double cylinder including an inner cylindrical member supported for vertical movement, and a bottom plate of the main body of the bucket movable between a closed position and an open position.

Additional and other objects, features and advantages of the invention will become apparent from the description set forth hereinafter when considered in conjunction with the accompanying drawings.

DESCRIPTION OF THE PREFERRED EMBODIMENTS

Figure 1:
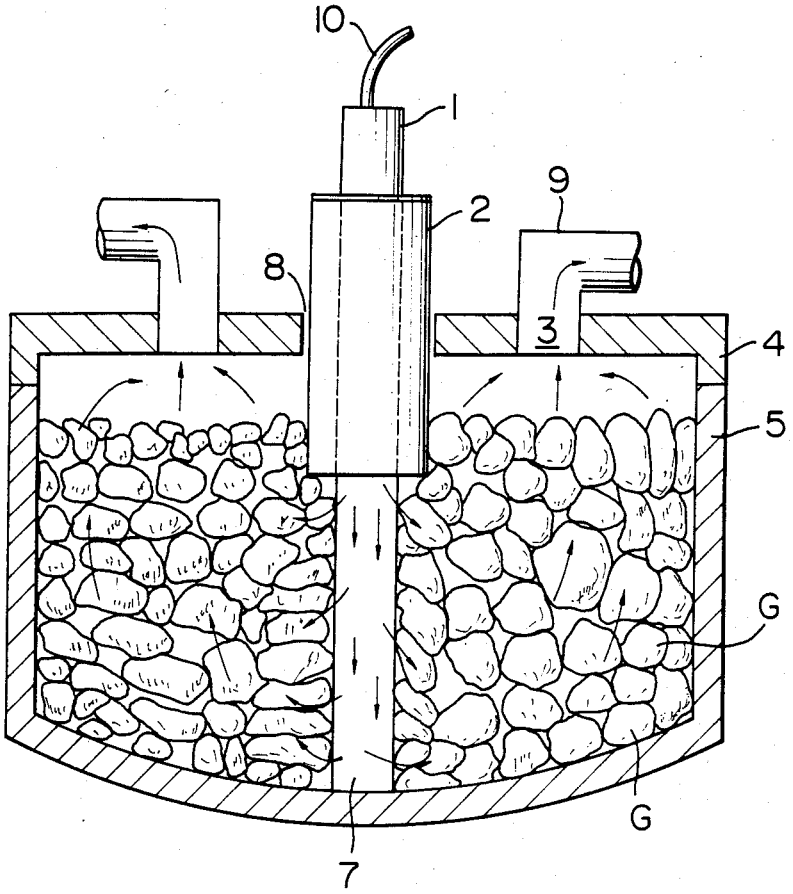
FIG. 1 is a schematic sectional view of a preheating furnace.

FIG. 1 shows a preheating furnace in which the raw materials charging device according to the invention can be incorporated to obviate the aforesaid problems with which the preheating furnace of the prior art is faced with.

The preheating furnace 5 is for preheating raw materials G, such as scrap, by exhaust gas, for example. A gas passage 7 is formed in a stack of raw materials G to minimize a pressure loss of the gas and allow heat exchange to take place vigorously. The preheating furnace 5 has a furnace cover 4 firmly secured thereto which is formed with exhaust gas ports 3 having respective ducts 9 communicating therewith. The furnace cover 4 is formed with an opening 8 in which a cylindrical heating vessel 2 having a high temperature gas supply device 1 at its upper portion is inserted for sliding movement. The numeral 10 designates a fuel or gaseous fuel inlet pipe. The heating vessel 2 may have many constructional forms the details of which may be conventional and are not shown.

The heating vessel 2, which may have any one of the aforesaid constructional forms, is inserted in the preheating furnace 5 through the opening 8 at the furnace cover 4 into contact with a top end portion of the gas passage 7 in the stack of raw materials G to be force fitted thereto. Furthermore, a forward end portion of the heating vessel 2 may be submerged in the stack of raw materials G to connect the forward end portion of the heating vessel 2 with the gas passage 7 in the stack of raw materials G, to provide a seal to the gas passage 7 to enable gas of high temperature supplied from the heating vessel 2 to circulate satisfactorily through the stack of raw materials G in the furnace 5. This is conducive to improved uniform raw materials preheating and increased preheating efficiency.

Figure 2:
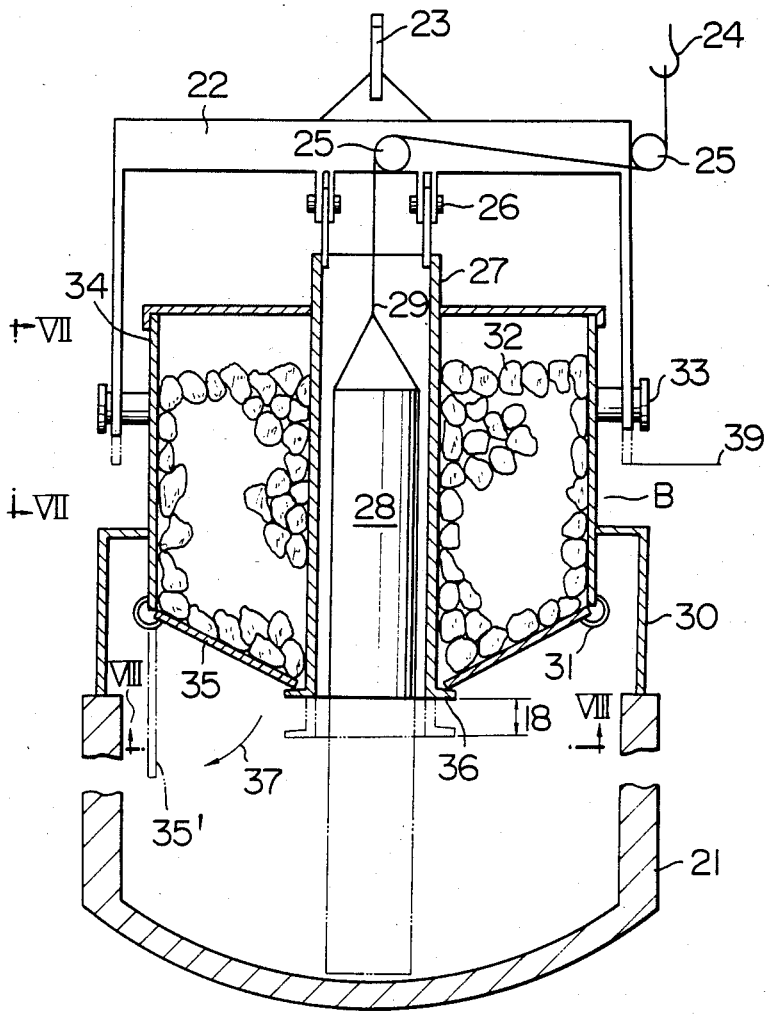
FIG. 2 is a vertical sectional view of the raw materials charging device comprising one embodiment of the invention.
Figure 5:
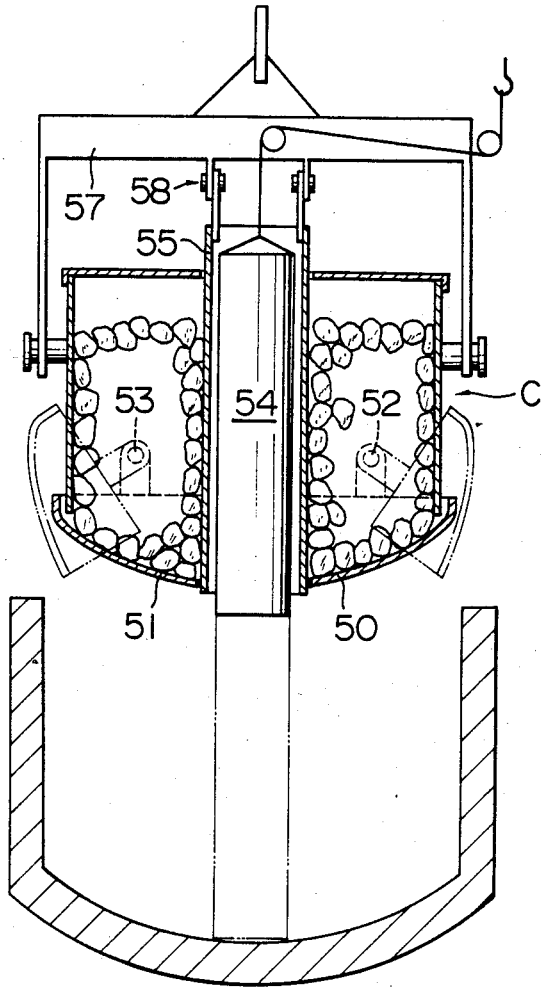
FIG. 5 is a vertical sectional view of the raw materials charging device comprising another embodiment.

FIG. 2 shows one embodiment of the raw materials charging device for a preheating furnace in conformity with the invention. As shown, the raw materials charging device is suitable for use in charging a preheating furnace 21 with raw materials 32, such as scrap, which are preheated in the furnace 21 by waste gas of high temperature, for example. The raw materials charging device according to the invention comprises a main body 34 of a bucket B for conveying the raw materials 32 to the furnace 21. The bucket B is suspended from a suspension beam 22 through trunnions 33 connected to the main body 34 of the bucket B. Each trunnion 33 is loosely inserted, as shown in FIG. 5, in a slot 41 formed in the suspension beam 22 which is suspended from a main hoist 23 as shown in FIG. 2.

The raw materials charging device further comprises a double cylinder including an outer cylindrical member 27, and an inner cylindrical member 28 which is loosely fitted in the outer cylindrical member so that the two cylindrical members 27 and 28 may move vertically independently of each other. The double cylinder of this construction and operation is inserted in a substantially central portion of the main body 34 of the bucket B coaxially therewith. The outer cylindrical member 27 is suspended at its upper end from the suspension beam 22 through pins 26, and the inner cylindrical member 28 is suspended from an auxiliary hoist 24 by a wire rope 29 through sheaves 25 connected to the suspension beam 22.

The main body 34 of the bucket B has a bottom plate 35 split into a plurality of segmental bottom plate sections 35-*n* which are supported by hinged joints 31 at an outer peripheral surface of the main body 34 of the bucket B for hingedly moving outwardly from a central portion of the bottom plate 35 to open the bottom plate 35. By reversing the process, the bottom plate 35 is closed. Forward ends of the bottom plate sections 35-*n* are releasably supported at a support 36 formed at a lower end of an outer peripheral surface of the outer cylindrical member 27, so that the forward ends of the bottom plate sections 35-*n* are brought out of engagement with the support 36 when the outer cylindrical member 27 is moved downwardly.

The main body 34 of the bucket B has connected to a lower portion of its outer peripheral surface a skirt 30 at which the main body 34 is placed on the preheating furnace 21, so that the skirt 30 bears the weight of the bucket B.

An example of operation of the raw materials charging device of the aforesaid construction according to the invention will now be described. When the bucket B having the raw materials G charged into the main body 34 is moved downwardly toward a throat of the furnace 21 as wires are payed out of the main hoist 23 and auxiliary hoist 24 through the sheaves 25, the skirt 30 at the lower portion of the main body 34 is brought into abutting engagement with a wall of the preheating furnace 21 while the inner cylindrical member 28 is brought into abutting engagement with a bottom of the furnace 21. When the wire is payed out of the main hoist 23, the suspension beam 22 moves downwardly for a distance 18, which corresponds to the extent of the slots 41 formed therein, to a position indicated by the reference numeral 39. The outer cylindrical member 27 which is connected to the suspension beam 22 through the pins 26 also moves downwardly for the distance 18. Downward movement of the outer cylindrical member 27 for the distance 18 results in the forward ends of the bottom plate sections 35-*n* being brought out of engagement with the support 36 and moving outwardly from the central portion of the bottom plate 35 as indicated by an arrow 37, so that the bottom plate 35 moves to a phantom line position 35'. This allows the raw materials G in the main body 34 of the bucket B to be charged into the preheating furnace 21 therefrom.

After the raw materials G have been charged into the preheating furnace 21, the wire 29 is wound on the auxiliary hoist 24 to return the inner cylindrical member 28 to its original position in the outer cylindrical member 27.

Withdrawal of inner cylindrical member 28 forms a gas passage 7 in the stack of charged raw materials G to minimize pressure losses by the hot exhaust gas and to allow heat exchange to take place vigorously as previously indicated with reference to FIG. 1.

Figure 3:
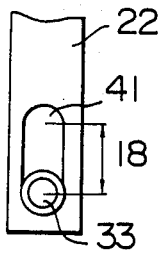
FIG. 3 is a sectional view taken along the line VII—VII in FIG. 6.
Figure 4:
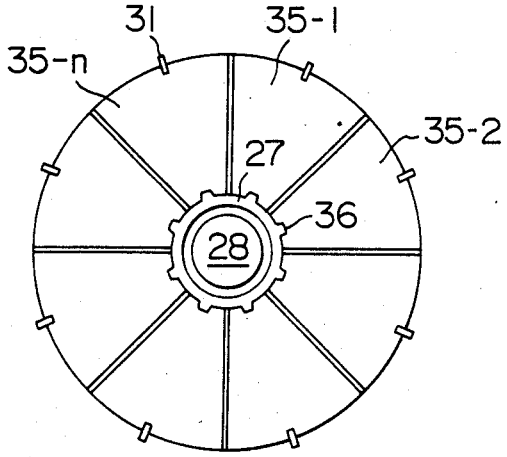
FIG. 4 is a sectional view taken along the line VIII—VIII in FIG. 6.

FIG. 5 shows another embodiment of the raw materials charging device in conformity with the invention in which the mechanism for opening the bottom plate of a bucket C and the operation of the double cylinder are distinct from those of the embodiment shown in FIGS. 2–4. The bottom plate, which is split into two halves, includes bottom plate sections 50 and 51 of a shell shape, which are pivotably supported by pins 52 and 53 to move rightwardly and leftwardly respectively in FIG. 9 when the bottom plate is brought to an open position. When the bottom plate is thus opened or when the bottom plate sections 50 and 51 are brought to a phantom line position after lowering the inner cylindrical member 54, the raw materials in the bucket C are charged into a preheating furnace. An inner cylindrical member 54 is vertically movable as is the case with the inner cylindrical member 28 of the embodiment shown in FIGS. 2–4, but an outer cylindrical member 55 is prevented from moving vertically and is detachably connected at its upper end to a suspension beam 57 through check bolts 58. The bottom plate segments 50 and 51 may be opened and closed through ropes by a crane or electric motor, not shown.

Figure 6:
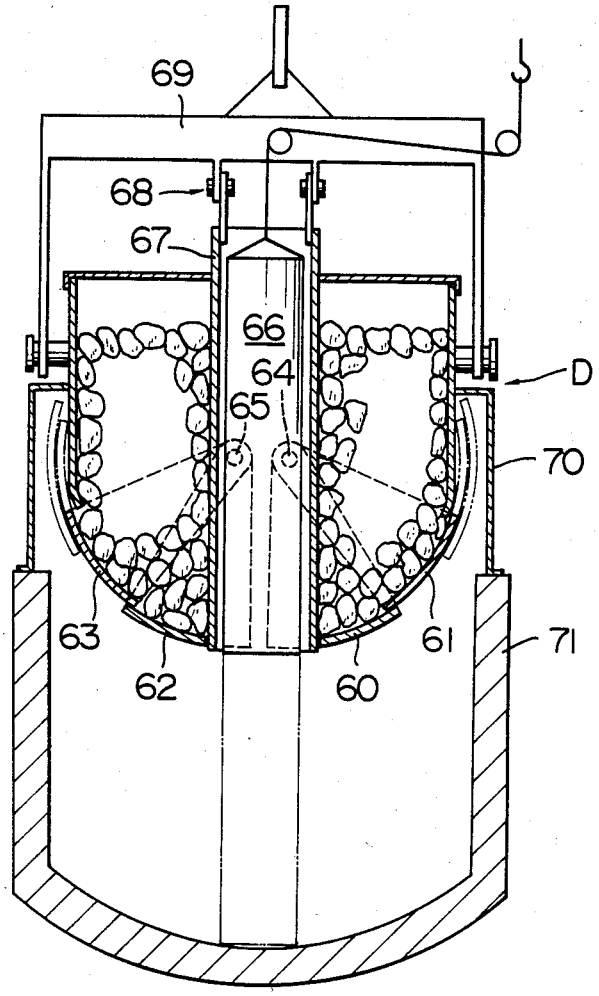
FIG. 6 is a vertical sectional view of the raw materials charging device comprising still another embodiment.

FIG. 6 shows still another embodiment of the raw materials charging device in conformity with the invention in which the mechanism for opening and closing the bottom plate of a bucket D and the operation of the double cylinder are distinct from those of the embodiments shown in FIGS. 2–5. The bottom plate of the bucket D is composed of a plurality of bottom plate sections 60, 61, 62 and 63 of an arcuate shape in cross section. The bottom plate sections 60 and 61 are pivotably supported by a pin 64 and the bottom plate sections 62 and 63 are pivotably supported by a pin 65 to move rightwardly and leftwardly respectively in FIG. 6 when the bottom plate is moved to an open position. When the bottom plate is thus opened or when the bottom plate sections 60, 61, 62 and 63 are brought to a phantom line position after lowering the inner cylindrical member 66, the raw materials in the bucket D are charged into a preheating furnace. Like the inner cylindrical member 27 of the embodiment shown in FIGS. 2–4, an inner cylindrical member 66 of this embodiment is vertically movable, but an outer cylindrical member 67 of this embodiment is prevented from moving vertically and is detachably connected at its upper end to a suspension beam 69 through check bolts 68. The bottom plate segments 60, 61, 62 and 63 may be opened and closed through ropes by a crane or electric motor, not shown. This embodiment is usually provided with a skirt 70 which is directly placed on a preheating furnace 71 to support the weight of the bucket D as a whole on the preheating furnace 71.

As clearly seen from the explanation of the present invention hereabove, the inner cylindrical member of the present invention may be hollow in its inside, when the weight of the inner column should be reduced. The gist of the present invention is not lost if the horizontal section of the outer sleeve and/or the inner column may be changed in accordance with the type of preheating furnace to be used or with the type of the bucket.

What is claimed is:

1. A raw materials charging device comprising:

a bucket for charging raw materials, said bucket having a main body and a bottom plate movable between a closed position and an open position for introducing a charge of said raw materials from said main body into a furnace;

an outer cylindrical member;

an inner cylindrical member positioned coaxially and vertically movable in the outer cylindrical member, both of said cylindrical members being located in the main body of the bucket coaxially therewith; and means for moving said inner cylindrical member out of said outer cylindical member and into said furnace before introducing said charge into said furnace and for moving said inner cylindrical member out of said furnace and into said outer cylindrical member after introducing said charge into said furnace so as to form a passage in said charge for heating said raw materials with a gas.

2. A raw materials charging device as claimed in claim 1, wherein said inner cylindrical member is vertically movable but said outer cylindrical member is prevented from moving vertically, and said bottom plate is split into two bottom plate sections of a shell shape for movement rightwardly and leftwardly respectively when the bottom plate is moved to an open position.

3. A raw materials charging device as claimed in claim 1, wherein said inner cylindrical member is vertically movable but said outer cylindical member is prevented from moving vertically, and said bottom plate is composed of four bottom plate segments of an arcuate shape in cross-section movable rightwardly and leftwardly when the bottom plate is moved to an open position.

4. A raw materials charging device comprising:

a main body of a bucket for charging raw materials;

an outer cylindrical member;

an inner cylindrical member positioned coaxially and vertically movable in the outer cylindrical member, both of said cylindrical members being located in the main body of the bucket coaxially therewith in such a manner that the inner and outer cylindrical members are both vertically movable independently of each other;

a bottom plate of the bucket split into a plurality of segmental bottom plate sections movable between a closed position and an open position, said segmented bottom plate sections being supported for movement away from a central portion of the bottom plate outwardly thereof to open the bottom plate so as to introduce a charge of said raw materials from said main body into a furnace;

support means located at an outer periphery of the outer cylindrical member for releasably supporting forward ends of the segmental bottom plate sections such that the same move outwardly to open the bottom plate when the outer cylindrical member moves downwardly;

a skirt located at a lower end portion of an outer periphery of the main body of the bucket for supporting the main body on said furnace by bearing the weight of the bucket; and, means for moving said inner cylindrical member out of said outer cylindrical member and into said furnace before introducing said charge into said furnace and for moving said inner cylindrical member out of said furnace and into said outer cylindrical member after introducing said charge into said furnace so as to form a passage in said charge for heating said raw materials with a gas.

5. A raw materials charging device according to claim 1 in which said inner cylindrical member is movable downwardly into abutting engagement with a substantially central portion of a bottom wall of said furnace, and in which said moving means maintains said abutting engagement while said charge of raw materials is being introduced from said main body into said furnace.

6. A raw materials charging device according to claim 5 in which said heating gas leaves said charge through a cover of said furnace.

7. A raw materials charging device according to claim 4 in which said inner cylindrical member is movable downwardly into abutting engagement with a substantially central portion of a bottom wall of said furnace, and in which said moving means maintains said abutting engagement while said charge of raw materials is being introduced from said main body into said furnace.

8. A raw materials charging device according to claim 7 in which said heating gas leaves said charge through a cover of said furnace.

* * * * *